US007852278B2

(12) United States Patent
Choudhury

(10) Patent No.: US 7,852,278 B2
(45) Date of Patent: Dec. 14, 2010

(54) CMOS IC AND HIGH-GAIN ANTENNA INTEGRATION FOR POINT-TO-POINT WIRELESS COMMUNICATION

(75) Inventor: Debabani Choudhury, Thousand Oaks, CA (US)

(73) Assignee: Intel Corporation, Santa Clara ( * ) Notice: Subject to any disclaimer, the term of this patent is extended or adjusted under 35 U.S.C. 154(b) by 0 days.

(21) Appl. No.: 12/775,137

(22) Filed: May 6, 2010

(65) Prior Publication Data

US 2010/0214186 A1 Aug. 26, 2010

Related U.S. Application Data

(62) Division of application No. 11/807,987, filed on May 31, 2007, now Pat. No. 7,737,894.

(51) Int. Cl.
*H01Q 13/02* (2006.01)

(52) U.S. Cl. ..... 343/786; 343/700 MS

(58) Field of Classification Search ..... 343/700 MS, 343/786

See application file for complete search history.

(56) References Cited

U.S. PATENT DOCUMENTS

| | | | | |
|---|---|---|---|---|
| 2,239,724 | A | 4/1941 | Lindenbald | |
| 3,389,394 | A | 6/1968 | Bernard | |
| 4,723,305 | A * | 2/1988 | Phillips et al. | 455/575.7 |
| 4,905,013 | A | 2/1990 | Reindel | |
| 5,185,611 | A * | 2/1993 | Bitter, Jr. | 343/702 |
| 5,363,105 | A | 11/1994 | Ono et al. | |
| 7,019,707 | B2 * | 3/2006 | Gottwald et al. | 343/786 |
| 7,064,722 | B1 * | 6/2006 | Neel | 343/767 |
| 7,737,894 | B2 | 6/2010 | Choudhury | |
| 2008/0297429 | A1 | 12/2008 | Choudhury | |

OTHER PUBLICATIONS

"High-Grain Step Profiled Integrated Diagonal Horn Antennas." IEEE Trans. On MTT-40, May 1992, pp. 801-805.

"Unamplified Driect Detection Sensor for Passive Millimeter Wave Imaging." J. Lynch, H. Moyer, J. Schulman, p. Lawyer, R. Bowen, J. Schaffner, D. Choudhury, J. Foschaar, D. Chow, Proc. Of SPIE vol. 6211, 2006.

* cited by examiner

*Primary Examiner*—Tho G Phan
(74) *Attorney, Agent, or Firm*—Lee & Hayes PLLC

(57) ABSTRACT

A point-to-point radio communications device, with an integrated antenna-IC module, includes highly-directional antenna elements and silicon CMOS-based ICs in plastic packaging material. The high-gain horn-type antenna includes two sections made of molded plastic and covered in a metallic coating. When combined, the two sections form an aperture and an opening on a face. The face of the antenna element can be mounted directly to an integrated circuit with an antenna coupling element, such that the aperture forms a horn-IC module. The module can be completely enclosed in a plastic-packaging environment using low-cost approach. The antenna-IC module can be manufactured as an integral part of a case for a point-to-point wireless electronic device such as a mobile video phone or a set-top box with tens of gigabits of video downloading capability.

9 Claims, 4 Drawing Sheets

CMOS IC AND HIGH-GAIN ANTENNA INTEGRATION FOR POINT-TO-POINT WIRELESS COMMUNICATION

This application is a divisional of prior application Ser. No. 11/807,987, filed May 31, 2007, which is hereby incorporated herein by reference.

FIELD

The present invention relates generally to highly-directional antenna integration with silicon integrated circuits, and more specifically to millimeter wave high-gain horn antenna integration with CMOS ICs.

BACKGROUND

Current trend in utilizing 57-64 GHz high-data-rate spectrum for wireless communication calls for new, low-cost radios, integrated with set-top boxes or mobile platform/handsets. Energy propagation in this mm-wave band has unique characteristics which enables excellent immunity to interference, highly-secured communication, frequency re-use, etc. For low-cost point-to-point communication at this frequency range, highly directional, high-gain antennas are desired for integration with complementary metal oxide semiconductor (CMOS)-technology-based radios.

Waveguide horn structures are typically used for high gain, directional antennas at millimeter (mm) wave frequencies. Currently available metal horns are bulky, heavy, expensive, and non-ideal for planar, integrated circuit (IC) integration.

DESCRIPTION OF EMBODIMENTS

Figure 1:
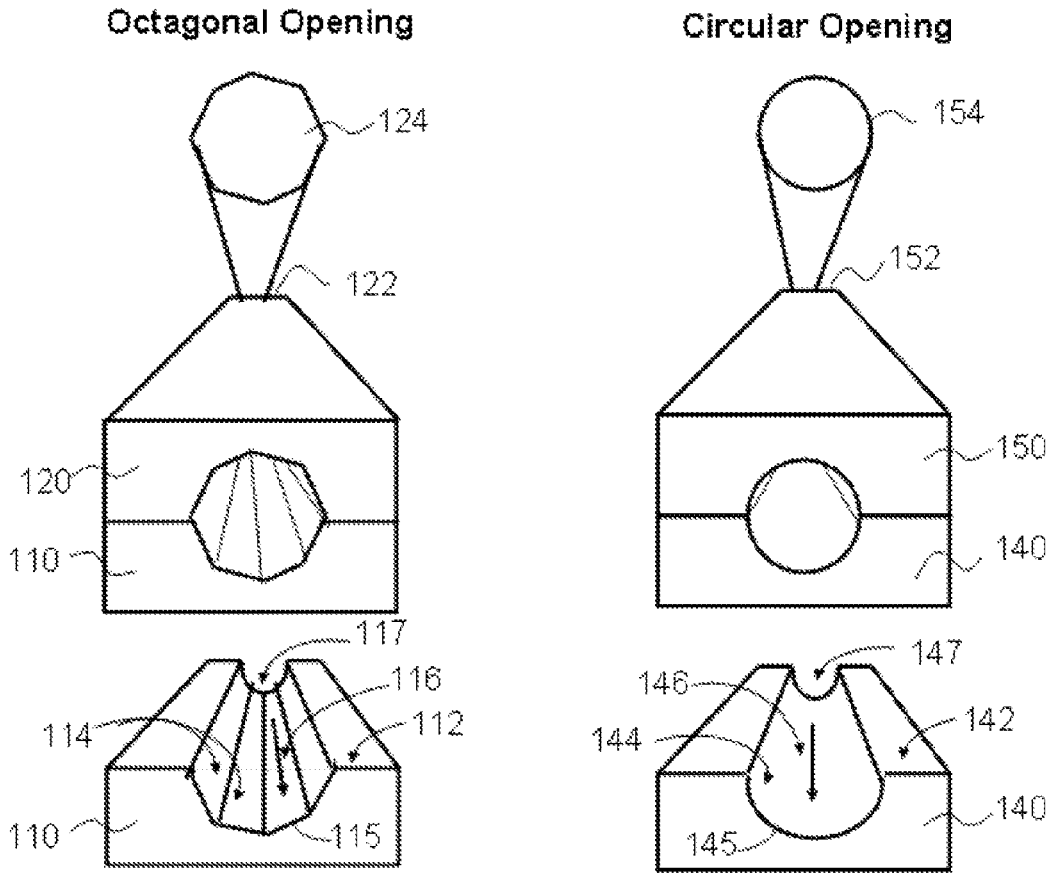
FIG. 1 shows perspective views of horn antenna element sections.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the spirit and scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

FIG. 1 shows perspective views of horn antenna sections. Horn antenna sections 110 and 140 each have an axis shown at 116 and 146, respectively. Horn antenna section 110 has an interior face 112 parallel to axis 116, and horn antenna section 140 has an interior face 142 parallel to axis 146.

Horn antenna section 110 has a notch in interior face 112 parallel to axis 116. The notch in section 110 has planar faces 114. Although the notch in section 110 is shown with four planar faces, this is not a limitation of the present invention. Any number of planar faces may be included. Horn antenna section 140 has a notch in interior face 142 parallel to axis 146. The notch in section 140 has a semicircular cross section 144. Other cross-section shapes may be utilized without departing from the scope of the present invention. For example, a cross-section of a notch may have any geometric shape.

The notches in sections 110 and 140 may have non-uniform depths. For example, the notch in horn antenna section 110 may be deeper at end 115 than at end 117. Also for example, the notch in horn antenna section 140 may be deeper at end 145 than at end 147. As described further below, when two sections with non-uniform depth notches are mated, the notches may form an angular or conical horn aperture.

In some embodiments, sections 110 and 140 are made of molded plastic. For example, the sections may be molded in the shape shown, or may be molded with a solid interior face and the notch may be machined. Portions of horn antenna sections 110 and 140 may be covered with a conductive material. For example, the notches and inner sides in sections 110 and 140 may be covered with a metallic material. In some embodiments, all of sections 110 and 140 are covered in a metallic material.

In some embodiments, a horn antenna may be made when two sections are combined such that the interior faces mate, and the notches form an aperture. For example, section 120 may be identical to section 110, and they may be coupled such that their interior faces mate. The notches in sections 110 and 120 form an aperture with openings on two ends. An exploded view of an octagonal opening 124 is shown at end 122 of the horn antenna formed by sections 110 and 120. Also for example, section 150 may be identical to section 140, and they may be coupled such that their interior faces mate and an aperture is formed with an opening on two ends. An exploded view of a circular opening 154 is shown at end 152 of the horn antenna formed by sections 140 and 150.

Apertures in the horn antennas may be diagonal, conical, or any other shape. For example, when the notches in sections 110 and 120 have non uniform depths, a diagonal shaped aperture may be formed in the resulting horn radiator. Also for example, when the notches in sections 140 and 150 have non-uniform depths, a conical shaped aperture may be formed in the resulting horn antenna.

In some embodiment, only the surface area of the notches are metalized. In these embodiments, the interior surfaces of the aperture are radiative. In other embodiments, the entire antenna radiator sections are metalized. This insures good metal coverage at the joints between reflector sections as well as good electrical connectivity. The ends of the horn may be metalized. For example, ends 122 and 152 have metallic coatings to allow the ends to be soldered to an integrated circuit having exposed metal. Various embodiments of horn antenna radiators coupled to CMOS-based integrated circuits are described below with reference to FIG. 3.

Figure 2:
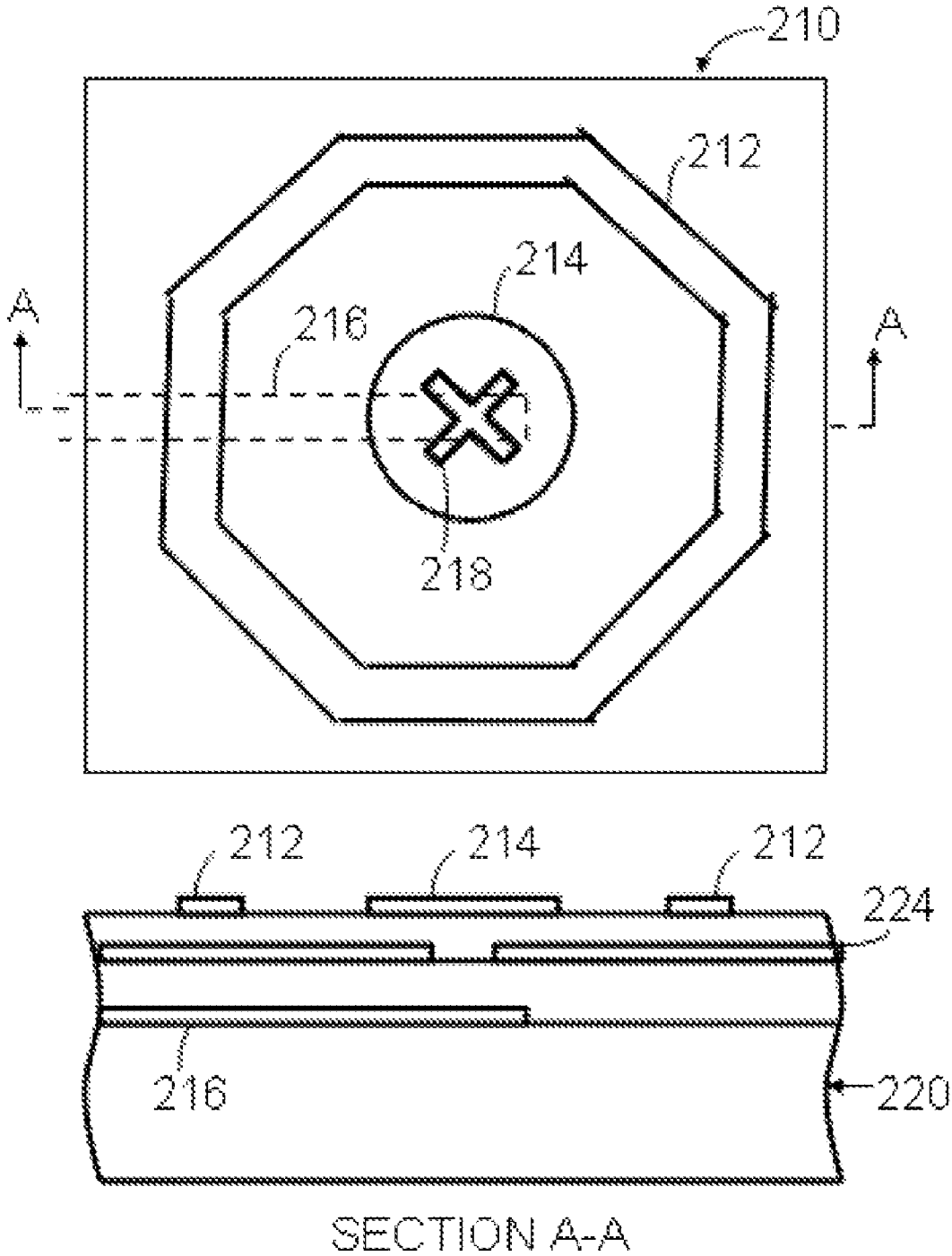
FIG. 2 shows an integrated circuit top view and cross-section with CMOS based IC to antenna transition example.

FIG. 2 shows an integrated circuit to highly directional antenna transition top view and cross section. As an example, top view 210 and cross sectional view 220 show metal face 212, patch 214, and antenna feed line 216. Top view 210 also shows cross slots 218 in patch 214, and cross section view 220 also shows metal layer 224.

Metal face 212, patch 214, metal layer 224, and feed line 216 are all formed on metal layers within the integrated circuit. As shown in cross section view 220, the metal layers are separated by insulating layers. The integrated circuit structure shown in FIG. 2 may be manufactured using dielectric and metal layers on top of the CMOS-based silicon IC substrate.

Metal face 212 is formed in a geometric pattern. Metal face 212 is shown as octagonal in shape in FIG. 2, but this is not a limitation of the present invention. For example, metal face 212 may be circular, oval, hexagonal, or any other geometric shape. In general, the geometric pattern of metal face 212 matches the geometric pattern of a horn antenna radiator opening to which it will be mated, although the various embodiments of the invention also contemplate mating dissimilar shaped metal faces and horn radiator openings.

In operation, feed line 216 is excited with a signal, and energy radiates through the hole in metal layer 224, and through cross-slot 218 in patch 214. A horn antenna may be attached to metal face 212, thereby creating a directional antenna-IC module. The dimensions of the various elements in the integrated circuit and the size of the horn may be modified to tune the antenna structure to various frequencies. For example, the elements may be sized to tune the antenna structure to mm-wave frequencies.

Figure 3:
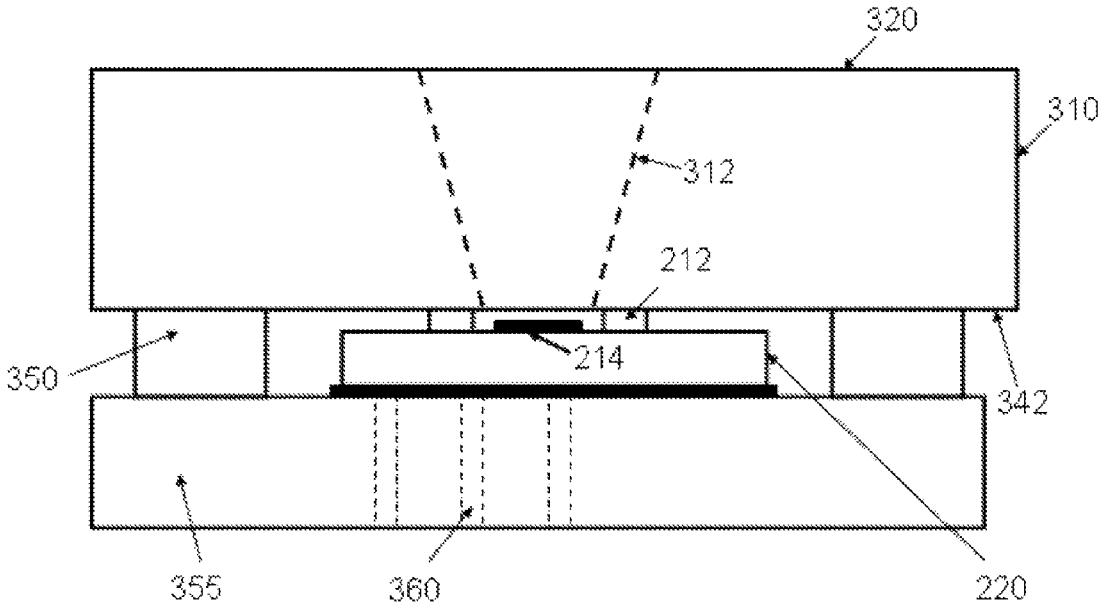
FIG. 3 shows a modular combination of CMOS integrated circuit and horn antenna element.

FIG. 3 shows a combination of CMOS-based silicon integrated circuit and horn antenna that are presented in FIGS. 2 and 1. Integrated circuit 220 is described above with reference to FIG. 2. Horn antenna 310 has an aperture 312 between two ends 320 and 342. End 342 of horn antenna 310 is coupled to integrated circuit 220 such that energy radiated through patch 214 is directed by aperture 312.

Horn antenna radiator 310 may be attached to integrated circuit 220 using any suitable method. For example, in some embodiments, end 342 is metal, face 212 is metal, and horn antenna 310 is soldered to integrated circuit 220. Also for example, in some embodiments, horn antenna 310 is glued with a conductive material to CMOS integrated circuit 220.

Horn antenna 310 may be any of the horn antenna embodiments disclosed herein. For example, horn antenna 310 may be any of the horn antenna made up of sections as shown in FIG. 1. The CMOS IC can be mounted on any plastic materials, 355. PCB type plastic boards can be used as 355. Section 350 presents the junction between 355 and metalized plastic-horn faces, 342. Thermal vias, 360, may be used, if necessary in the modular assembly.

Figure 4:
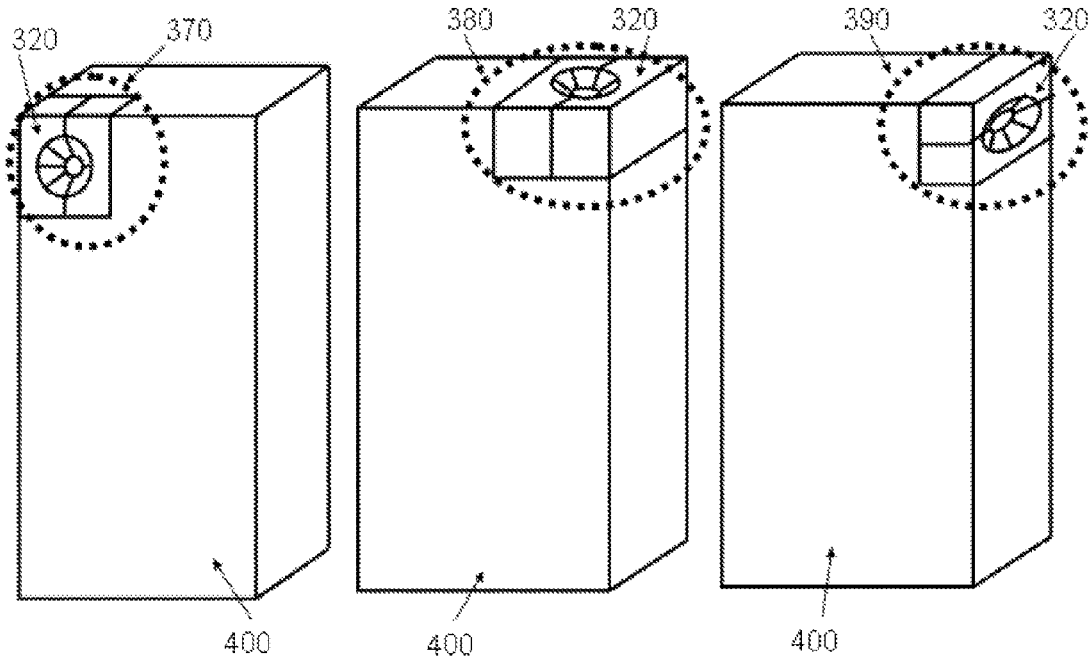
FIG. 4 shows mobile communications device with embedded directional antenna integrated radio.

FIG. 4 shows a mobile communications device. Mobile communications device 400 includes horn antenna 320. In some embodiments, horn antenna radiator assemblies 370, 380, 390 are manufactured separately from, and then attached to, the different parts of the body of the mobile communications device 400. Also in some embodiments, the two pieces of horn antenna 320 are manufactured as part of two pieces of the body of mobile communications device 400. The aperture in horn antenna 320 is then formed when the body for mobile communications device is assembled. Horn antenna 320 is coupled to an integrated circuit as shown in FIG. 3. Horn antenna assemblies 370, 380, 390 may be mounted at different parts of the mobile communications device, as necessary for the communication.

Mobile communications device 400 may be any type of device that includes a horn antenna. For example, mobile communications device 400 may be a mobile video downloading device, mobile phone, a personal digital assistant, a portable music player, or any other mobile communications device. Horn antenna 320 may be coupled to an antenna used for any type of communications. For example, the antenna may support signal transmission and reception in support of wireless high definition multimedia interface (HDMI), point-to-point personal area networks (WPAN) type of applications.

The antenna-CMOS-IC embodiments may be mounted on a set-top box similar to the mobile device for high-data rate communications, such as, video downloading.

Although the present invention has been described in conjunction with certain embodiments, it is to be understood that modifications and variations may be resorted to without departing from the spirit and scope of the invention as those skilled in the art readily understand. Such modifications and variations are considered to be within the scope of the invention and the appended claims.

What is claimed is:

1. An antenna radiator comprising:

a first section having a first axis, a first interior face parallel to the first axis, and a first notch in the first interior face, the first notch being parallel to the first axis; and a second section having a second axis, a second interior face parallel to the second axis, and a second notch in the second interior face, the second notch being parallel to the second axis;

wherein the first and second sections are coupled to mate the first and second interior faces to form an aperture from the first and second notches, and to form an opening to the aperture on a face of the antenna reflector perpendicular to the first and second axes of the first and second sections.

2. The antenna radiator of claim 1 wherein the first and second notches have semicircular cross sections, and the opening is circular.

3. The antenna radiator of claim 2 wherein the first and second notches have non-uniform depth along the first and second axes, and the aperture is conical.

4. The antenna radiator of claim 1 wherein the first and second notches each include multiple planar faces.

5. The antenna radiator of claim 1 wherein the opening is octagonal.

6. The antenna radiator of claim 1 wherein the first and second sections comprise molded plastic.

7. The antenna radiator of claim 6 wherein the first and second notches include a metallic coating.

8. The antenna radiator of claim 7 wherein the face includes a metallic coating.

9. The antenna radiator of claim 8 wherein the first and second sections include a metallic coating.

* * * * *